United States Patent [19]

Caine

[11] 4,131,060

[45] Dec. 26, 1978

[54] SELF-CLOSING EXHAUST FAN COVER

[75] Inventor: Merwin A. Caine, Jackson, N.J.

[73] Assignee: The Crest Company, Jackson, N.J.

[21] Appl. No.: 794,599

[22] Filed: May 6, 1977

[51] Int. Cl.[2] ..... F04D 25/14

[52] U.S. Cl. ..... 98/116; 98/119; 98/43 R

[58] Field of Search ..... 98/43, 43 R, 114, 116, 98/119; 137/854

[56] References Cited

U.S. PATENT DOCUMENTS

| | | | |
|---|---|---|---|
| 1,189,572 | 7/1916 | Ilg | 98/116 |
| 2,812,703 | 11/1957 | Tobey | 98/43 R |
| 3,202,083 | 8/1965 | Eichhorn | 98/116 |
| 3,472,150 | 10/1969 | Strawsine | 98/116 |
| 3,479,947 | 11/1969 | Myers | 98/116 |

*Primary Examiner*—Allen M. Ostrager

*Attorney, Agent, or Firm*—Blum, Moscovitz, Friedman & Kaplan

[57] ABSTRACT

A fan cover assembly adapted to cover a fan when not in use and permitting the passage of air in the exhaust direction while the fan is operating. The fan cover assembly includes a frame having openings and a valve element secured to the frame and biased against the frame to close the openings when the fan is off. The valve element is pulled back from the openings to allow air to pass in the exhaust direction when the fan is operating.

10 Claims, 5 Drawing Figures

10
11
12
13
14
15
16
17
18
19
20
21
22
23
24
25
26
27
28
29
30
31
32
A
3

SELF-CLOSING EXHAUST FAN COVER

BACKGROUND OF THE INVENTION

This invention relates generally to an exhaust fan cover assembly of the type normally provided with magnetized fittings to permit selective securement to the grill of an exhaust fan. While exhaust fan covers have taken various forms, they have been complex in order to prevent leakage of air when the fan is off. Other types of fan covers do not open so they must be removed when the fan is in use. This latter type is undesirable when the fan is located in inaccessible locations.

SUMMARY OF THE INVENTION

Generally speaking, in accordance with the invention, a self-closing exhaust fan cover assembly is provided which includes a fan cover frame with at least one opening in its face and a valve element which covers the opening when the fan is not operating. The fan cover frame is essentially dome-shaped of sufficient size to cover fully an exhaust fan opening. The frame includes a flange at its base with indentations in the flange for placing magnets to permit selective securement of the fan cover to the face plate of an exhaust grill.

The resilient valve element is secured to the center of the domed frame and is biased against the underside of the frame to cover completely the openings in the frame when the fan is off. When the fan is operating, exhaust pressure deflects the valve elements away from the frame to permit air to pass in the exhaust direction. When the fan is turned off, the valve blades return to their normally closed position, biased against the cover frame.

Accordingly, it is an object of this invention to provide an improved exhaust fan cover.

Another object of the invention is to provide an improved exhaust fan cover which need not be removed when the fan is operating.

A further object of the invention is to provide an improved exhaust fan cover capable of permitting air to flow in one direction only.

Still other objects and advantages of the invention will in part be obvious and will in part be apparent from the specification and drawings.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2, 3, 4, 5:
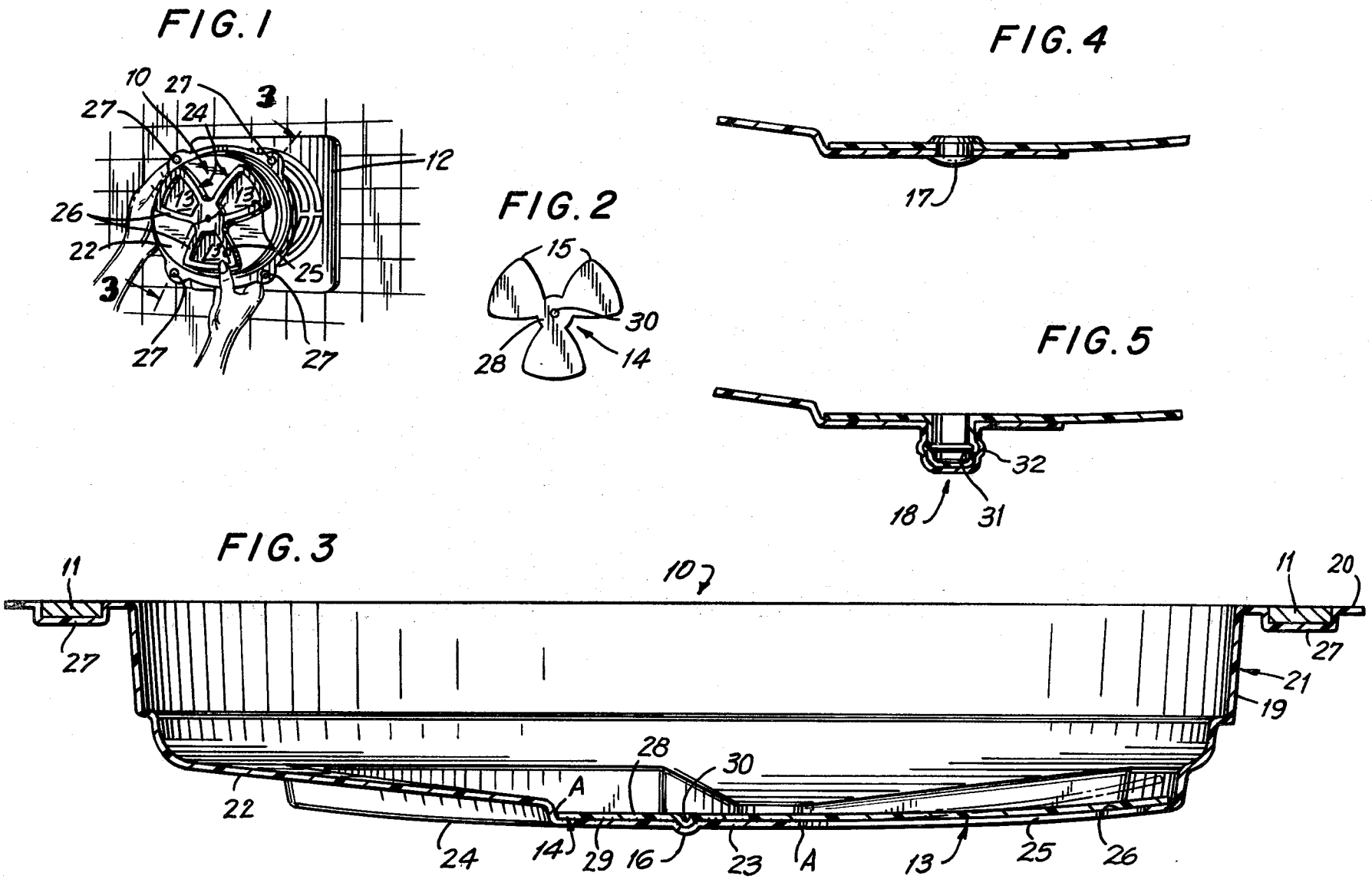
FIG. 1 is a perspective view of an exhaust fan cover containing the self-closing valve constructed in accordance with a preferred embodiment of the invention.
FIG. 2 is a plan view of the valve element of the fan cover.
FIG. 3 is a sectional view of the exhaust fan cover taken along line 3—3 of FIG. 1.
FIGS. 4 and 5 are partial sectional views showing alternative means for fastening the valve element.

Referring now to FIGS. 1 and 3, a self-closing fan cover assembly 10 in accordance with the invention is shown. Fan cover assembly 10, includes a one-piece frame 21 and resilient valve element 14. Valve element 14 is secured to frame 21 in a manner to be discussed below. Frame 21 consists of an annular, substantially cylindrical wall 19 joined at one end to a flange 20 which extends outwardly in a radial direction. The other end of annular wall 19 is bridged by a substantially dome-shaped top wall 22 having a substantially flattened central region 23. Three substantially fan-shaped projecting regions 24 in top wall 22 radiate from central region 23. Said projecting regions project in a direction away from annular wall 19 and are each formed with an opening 25 in the top surface thereof shaped to form a peripheral flange 26 in each said projecting region top surface to define a valve seat, as more particularly discussed below.

Flange 20 is formed with walls 27 for receiving magnets 11 to allow selective securement of fan cover assembly 10 to the face plate 12 of an exhaust grill of conventional design, frame 21 being shaped so that flange 20 engages the front surface of face plate 12.

FIG. 2 shows resilient valve element 14 which includes a central portion 28 and radially extending blades 15 shaped to conform with opening 13 of frame 21 for receipt in projecting portions 26. Valve element 14 is secured to frame 21 at their respective centers by a variety of means, such as, glue 29 or other suitable fastener means. Each valve blade 15 is shaped to cover completely the corresponding opening 25 in each projecting region 24 and to engage the corresponding flange 26 about each such opening.

Once valve element 14 and frame 21 are assembled, valve element 14 is in a closed position and valve blades 15 bias against the respective flanges 26 to close completely the respective openings 25. This closed position is assured by forming frame 21 so that an angle is defined between the central region 29 of top wall 22 and the flanges 26 surrounding the respective openings 25 as shown in FIG. 3. This insures that valve blade 15 will be resiliently disposed so as to abut flanges 26 and close openings 25.

When assembly 10 is positioned over a fan, valve element 14 will remain in its closed position. When the exhaust fan is operating, pressure created by the fan deflects valve blades 15 away from frame 21 and permits the flow of air in the exhaust direction through openings 25. When the fan is turned off, valve blades 15 return to their normally closed position biased against frame 21.

As shown in the drawings, the central portion of the cover face is intact to enable securing valve element 14 to frame 21. FIGS. 3, 4 and 5 show resilient valve element 14 attached to frame 21 by a variety of means. For example, FIG. 3 shows depression 16 in frame 21 and projection 30 in valve element 14 at their respective centers, to insure correct placement of valve element 14 during assembly. In this embodiment of the invention, valve element 14 is secured to frame 21 by glue applied to the respective central regions thereof along line A—A as shown in FIG. 3. In the embodiment of FIG. 4, valve element 14 and frame 21 are fastened by means of rivet 17. In the embodiment of FIG. 5, valve element 14 is provided with a central locking projection 31 and frame 21 is provided with matching depression 32 to allow ready assembly and fastening.

The angle between the central region 23 of frame 21 and the plane of opening 13 insures that blades 15 are biased against frame 21 and completely close openings 25. This self-closing feature of the valve element permits the passage of air only in the exhaust direction. When the force of air is from the outside (in the opposite direction to exhaust) valve blades 15 press against the flanges 26 of frame 21 and the valve will close more securely. This will serve to prevent the loss of heated air in winter and air conditioned air in summer. In addition, this feature enables the fan cover to be used in any horizontal, vertical or inclined position.

While in a preferred embodiment of the invention frame 21 contains three projecting regions spaced about the central region 23 of top wall 22 of frame 21 as shown in FIGS. 1 and 3, this arrangement is shown by way of example and not by way of limitation. Any number of openings may be provided in any position so long as a valve member is mounted so that a fixed portion is aligned at an angle to the periphery of the opening defining a valve seat to insure self-biasing of the valve member. The shape or size of the openings may also vary.

The shape of the fan cover frame may be varied to accommodate exhaust fan grills and openings of various shapes and sizes. Wall 19 may be annular or square or such other shape as to accommodate and mate with the fan grill.

Resilient valve element 14 may be constructed from any resilient material, such as, a thin metallic material, or a plastic material, such as, polyethylene, polypropylene, or polyvinyl chloride. The cover and valve element need not be constructed from the same material, but the cover may be molded from the same material as the valve element. The top surface of the projecting portions preferably each substantially define a plane so that each flange 26 lies in a single plane at an angle to the plane of central region 23.

The most common use for the exhaust fan valve assembly will be positioning over a wall exhaust fan, such as the type of wall fan utilized in a kitchen. The self-closing feature of the assembly enables the fan cover to remain intact covering the exhaust fan when it is operating, thereby eliminating the need to remove and store the cover at such time. This feature is especially useful for covering fans in ceilings or high places on walls that cannot be reached readily under ordinary circumstances.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An exhaust fan cover assembly comprising a frame of sufficient size to cover a fan assembly, said frame having a periphery substantially defining a plane and a substantially dome-shaped region projecting from the plane defined by said periphery, said dome-shaped region having at least one, opening in a region thereof spaced from the apex of said dome-shaped region, and a resilient valve element secured to the inner surface of the dome-shaped region of said frame at a position proximate to said opening and on the side of said opening nearest to the apex of said dome-shaped region, said valve element being shaped to close completely said opening by tension against the inner surface of the dome-shaped portion of said frame at the periphery of said opening, each point on the periphery of said opening defining an angle less than 180° with the position at which said valve element is secured to tension said valve element against said frame.

2. The exhaust fan cover of claim 1, wherein said frame is dome-shaped with a central flat portion, and wherein said valve element is secured to the central flat portion of said frame to face said fan.

3. The exhaust fan cover of claim 1, wherein the valve element is constructed of a resilient plastic material.

4. The exhaust fan cover of claim 1, wherein said domed frame has at least three openings.

5. The exhaust fan cover of claim 4, wherein said openings are web-shaped and each lies in a substantially planar section of said frame and wherein said valve element has three blades.

6. The exhaust fan cover of claim 5, wherein said frame is constructed with an angle between said central flat portion of said frame and the plane of said frame having said openings.

7. An exhaust fan cover assembly comprising a frame formed with a peripheral flange extending radially outwardly and a substantially dome-shaped portion bridging said flange, said dome-shaped portion being formed with a first substantially planar region and a second substantially planar region adjacent said first and formed with an opening therein, said first and second regions defining an angle therebetween, and a resilient valve element in a shape sufficient to close completely said opening and engage the portion of said second region surrounding said opening, said valve element being fixedly secured to the inner surface of said first region.

8. The fan cover of claim 7, including magnets mounted on the periphery of said flange for securing said fan cover assembly to a metal grill plate of an exhaust fan.

9. The fan cover of claim 7, including projecting means in said valve element and first region for relatively fixedly positioning same.

10. The fan cover of claim 7, wherein said valve element is formed of a plastic material.

* * * * *